US006934497B2

(12) United States Patent
Hagiwara et al.

(10) Patent No.: US 6,934,497 B2
(45) Date of Patent: Aug. 23, 2005

(54) IMAGE FORMING APPARATUS WITH BELT, PLURAL SENSITIZED BODIES, AND BELT POSITIONING MECHANISM

(75) Inventors: Kazuyoshi Hagiwara, Ebina (JP); Tadashi Ishikawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/352,053

(22) Filed: Jan. 28, 2003

(65) Prior Publication Data

US 2003/0219288 A1 Nov. 27, 2003

(30) Foreign Application Priority Data

May 21, 2002 (JP) ..... 2002-146289

(51) Int. Cl.[7] ..... G03G 15/01
(52) U.S. Cl. ..... 399/299; 399/302
(58) Field of Search ..... 399/162, 165, 399/298, 299, 302, 303, 54, 228

(56) References Cited

U.S. PATENT DOCUMENTS 6,324,374 B1 * 11/2001 Sasamoto et al. ..... 399/302
6,470,166 B2 * 10/2002 Mizoguchi et al. ..... 399/302

FOREIGN PATENT DOCUMENTS

| | | | | |
|---|---|---|---|---|
| JP | 2000-181184 | | 6/2000 | |
| JP | 2000266139 A | * | 9/2000 | ..... G03G/15/00 |
| JP | 2001-242680 | | 9/2001 | |

* cited by examiner

*Primary Examiner*—Arthur T. Grimley
*Assistant Examiner*—Ryan Gleitz
(74) *Attorney, Agent, or Firm*—Morgan, Lewis & Bockius LLP

(57) ABSTRACT

An image forming apparatus has a black sensitized body and plural color sensitized bodies arranged in a row as well as a belt adapted to move round on a course, sequentially passing by or coming into contact with the plural sensitized bodies, of which the black sensitized body is located at an end of the row, a roll for causing the belt to come into contact with the black sensitized body and a retractable roll located between the color sensitized body disposed at the other end of the row of the sensitized bodies opposite to the black sensitized body and the color sensitized body immediately adjacent to the black sensitized body and adapted to shift from a position for holding itself in contact with the belt to a position for separating itself from the belt and vice versa to change the course of round movement of the belt.

9 Claims, 9 Drawing Sheets

IMAGE FORMING APPARATUS WITH BELT, PLURAL SENSITIZED BODIES, AND BELT POSITIONING MECHANISM

BACKGROUND OF THE INVENTION

1. Field of the Invention

The present invention relates to an electrophotographic image forming apparatus that can be used for a copying machine, a printer, and so on.

2. Description of the Related Art

Two major types of conventional full color electrophotographic image forming apparatus include the so-called four-cycle type and the so-called tandem type. The electrophotographic image forming apparatus of the four-cycle type has a sensitized body and a developing unit that contains toners of a given number of different colors. As the sensitized body is driven to rotate, toner images of different colors are sequentially superposed to form on the sensitized body and transferred onto an object of transfer, one upon another to produce a color image. On the other hand, the tandem type has a given number of sensitized bodies that are provided with respective developing devices of different colors. A color image is produced on an object of transfer as the toner images formed on the respective sensitized bodies are sequentially superposed and transferred onto it.

Since the sensitized body and other related parts of the four-cycle type apparatus need to be rotated for the given number of cycles (typically four cycles) to produce a color image, the apparatus is accompanied by a problem of a low image forming rate. Therefore, the tandem type apparatus is preferentially used when images need to be formed at a high rate.

FIG. 1 of the accompanying drawings schematically illustrates an image forming apparatus having four photosensitized drums arranged in series and an intermediate transferring belt.

Referring to FIG. 1, the apparatus has four photosensitized drums 11Y, 11M, 11C and 11K arranged in series, on which respective toner images of Y (yellow), M (magenta), C (cyan) and K (black) are formed, an endless intermediate transferring belt 20 which is held by a number of rolls including a drive roll 22 for driving the belt 20, a tension/steering roll 23 for correcting the meandering movement, if any, of the belt 20, a backup roll 24, a tension roll 25 and a follower roll 26 and adapted to move while being held in contact with the four photosensitized drums 11Y, 11M, 11C and 11K arranged in series, primary transferring rolls 27Y, 27M, 27C and 27K arranged respectively opposite to the photosensitized drums 11 with the intermediate transferring belt 20 nipped between them to transfer the respective toner images onto the intermediate transferring belt 20 and a secondary transferring roll 28 arranged opposite to a backup roll with the intermediate transferring belt 20 nipped between them to transfer the toner images carried by the intermediate transferring belt 20 onto a sheet of paper P. The image forming apparatus additionally has a reference mark sensor 31 for detecting that the intermediate transferring belt 20 has just made a full turn and an edge sensor 32 for detecting the edges of the intermediate transferring belt 20. As viewed in the moving direction B of the intermediate transferring belt 20, the reference mark sensor 31 is arranged upstream relative to the photosensitized drum 11Y for forming a Y-color toner image whereas the edge sensor 32 is arranged downstream relative to the photosensitized drum 11K for forming a K-color toner image.

Since the tandem type image forming apparatus is adapted to drive all the given number of sensitized bodies to rotate simultaneously, unnecessary sensitized bodies have to be driven when the black and white mode of operation is selected, while all the sensitized bodies are driven to rotate as a matter of course when the color mode of operation is selected. Thus, the sensitized bodies are inevitably worn to a large extent. Additionally, if the sensitized bodies that do not participate in the operation of forming an image are held in contact with an object of transfer, the developing toners remaining on the sensitized bodies are wasted.

To dissolve this problem, Japanese Patent Application Laid-Open Publication No. 2001-242680 proposes an image forming apparatus having a belt-shaped member (an intermediate transferring member, a sensitized body, a paper-conveying member, and so on) and plural juxtaposed oppositely disposed members (sensitized bodies, developing agent carriers and so on) disposed opposite to the belt-shaped member as well as means for separating the belt-shaped member and some of the oppositely disposed members in order to separate unnecessary oppositely disposed members from the belt-shaped member.

The proposed image forming apparatus is believed to be able to avoid the problem of unnecessary wear of the oppositely disposed members.

However, since the separating means is arranged outside relative to one end of the row of the juxtaposed oppositely disposed members and forced to swing up and down in order to separate some of the oppositely disposed members from the belt-shaped member, the image forming apparatus inevitably has large dimensions.

On the other hand, if the profile of the transferring belt is altered for the purpose of separating unnecessary sensitized bodies from the transferring belt, it becomes highly difficult to accurately control the tensile force of the belt. Then, there arises a problem of a meandering belt.

Japanese Patent Application Laid-Open Publication No. 2000-181184 discloses an image forming apparatus having at least a pair of sensitized bodies, a sheet of paper conveying means and a transferring means and adapted to prevent any meandering movement of the belt and unnecessary wear of the sensitized bodies from taking place, by moving both the conveying means and the transferring means with respect to the axis of rotation of one of the sensitized bodies in order to separate the contact point of the sensitized body and the conveying means from the other sensitized body.

However, image forming apparatuses disclosed in Japanese Patent Application Laid-Open Publication Nos. 2001-242680 and 2000-181184 are still accompanied by a problem that they need a complex mechanism for separating the sensitized bodies adapted to carry respective images formed thereon from the belt.

SUMMARY OF THE INVENTION

The present invention has been made in view of the above identified circumstances and provides an image forming apparatus that can avoid the problem of unnecessary wear of sensitized bodies by selecting a monochrome mode or a plural color mode and also downsized the entire apparatus.

According to an aspect of the invention, an image forming apparatus that forms an image by forming toner images and fixing the toner images on a recording medium has plural sensitized bodies, a roll and a retractable roll explained as follows.

The plural sensitized bodies are arranged in a row and include a black sensitized body adapted to carry a black image formed thereon and other sensitized bodies adapted to carry respective images of different colors other than black formed thereon, and the black sensitized body is disposed at one of the opposite ends of the row of sensitized bodies.

The belt is adapted to move round on a course, sequentially passing by or coming into contact with the plural sensitized bodies, and receive the toner images formed on the plural sensitized bodies directly thereon or on a recording medium carried by the belt.

The roll is secured in position between the black sensitized body and the immediately adjacent color sensitized body and adapted to cause the belt to come into contact with the black sensitized body.

The retractable roll is located between the color sensitized body disposed at the other end of the row of the sensitized bodies and the color sensitized body immediately adjacent to the black sensitized body and adapted to shift from a position for holding itself in contact with the belt to a position for separating itself from the belt and vice versa to change the course of round movement of the belt.

An image forming apparatus according to the invention can operate for forming images in the black and white mode of operation and also in the color mode of operation without using photosensitized drums when they are not necessary for the image forming operation to reduce the frequency of driving each photosensitized drum. Therefore, the photosensitized drums and other related components can enjoy a long service life. Additionally, since the rolls arranged at the opposite ends of the course of movement of the belt to apply tension to the belt can be arranged close to the opposite ends of the row of photosensitized drums, it is possible to reduce the dimensions of the image forming apparatus and lay out its component easily.

BRIEF DESCRIPTION OF THE DRAWINGS

Preferred embodiments of the present invention will be described in detail based on the following figures, wherein.

DESCRIPTION OF THE PREFERRED EMBODIMENTS

Now, the present invention will be described by way of preferred embodiments of the invention.

Figure 1:
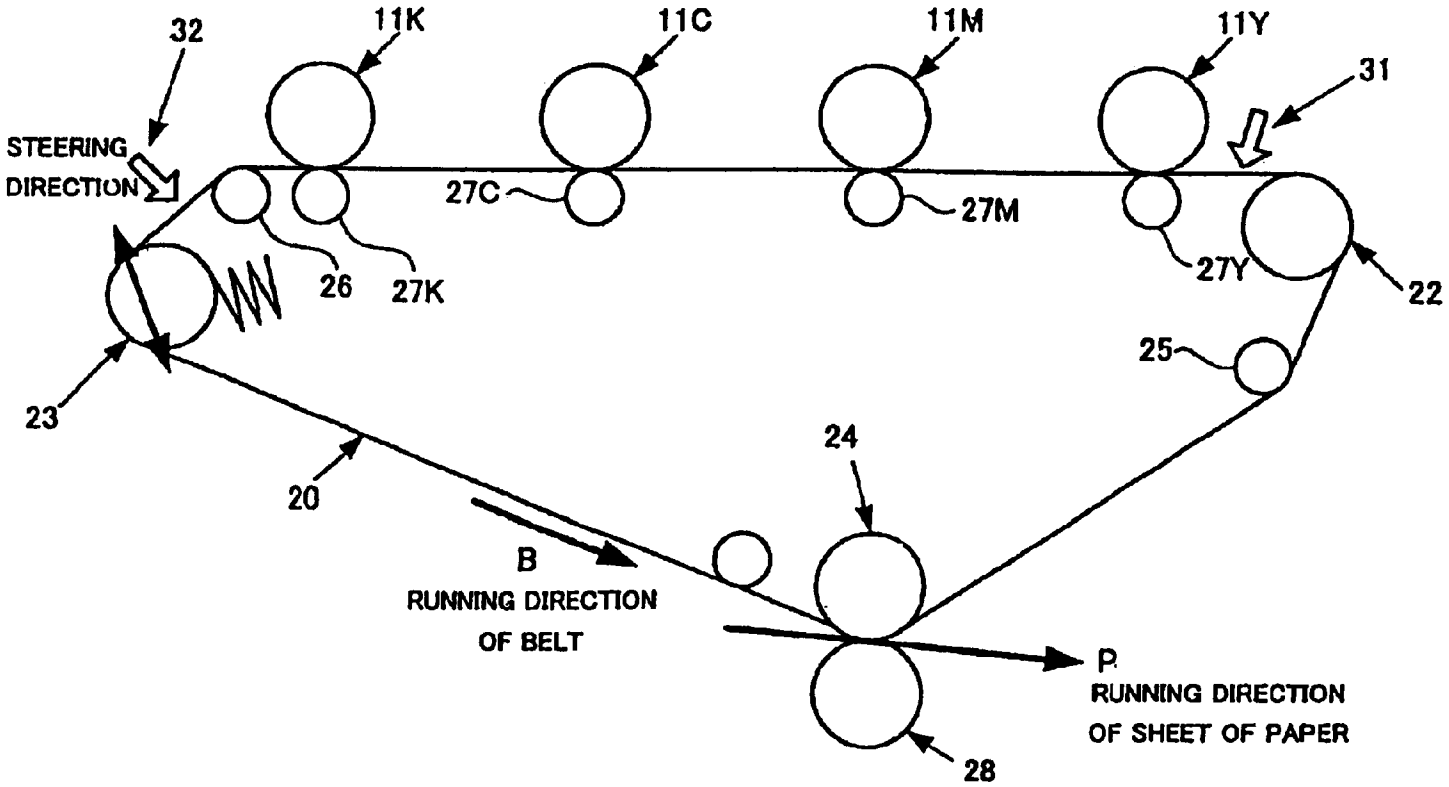
Fig. 1 (PRIOR ART)
FIG. 1 is a schematic cross sectional view of an image forming apparatus having four photosensitized drums arranged in series and an intermediate transferring belt.
Figure 2:
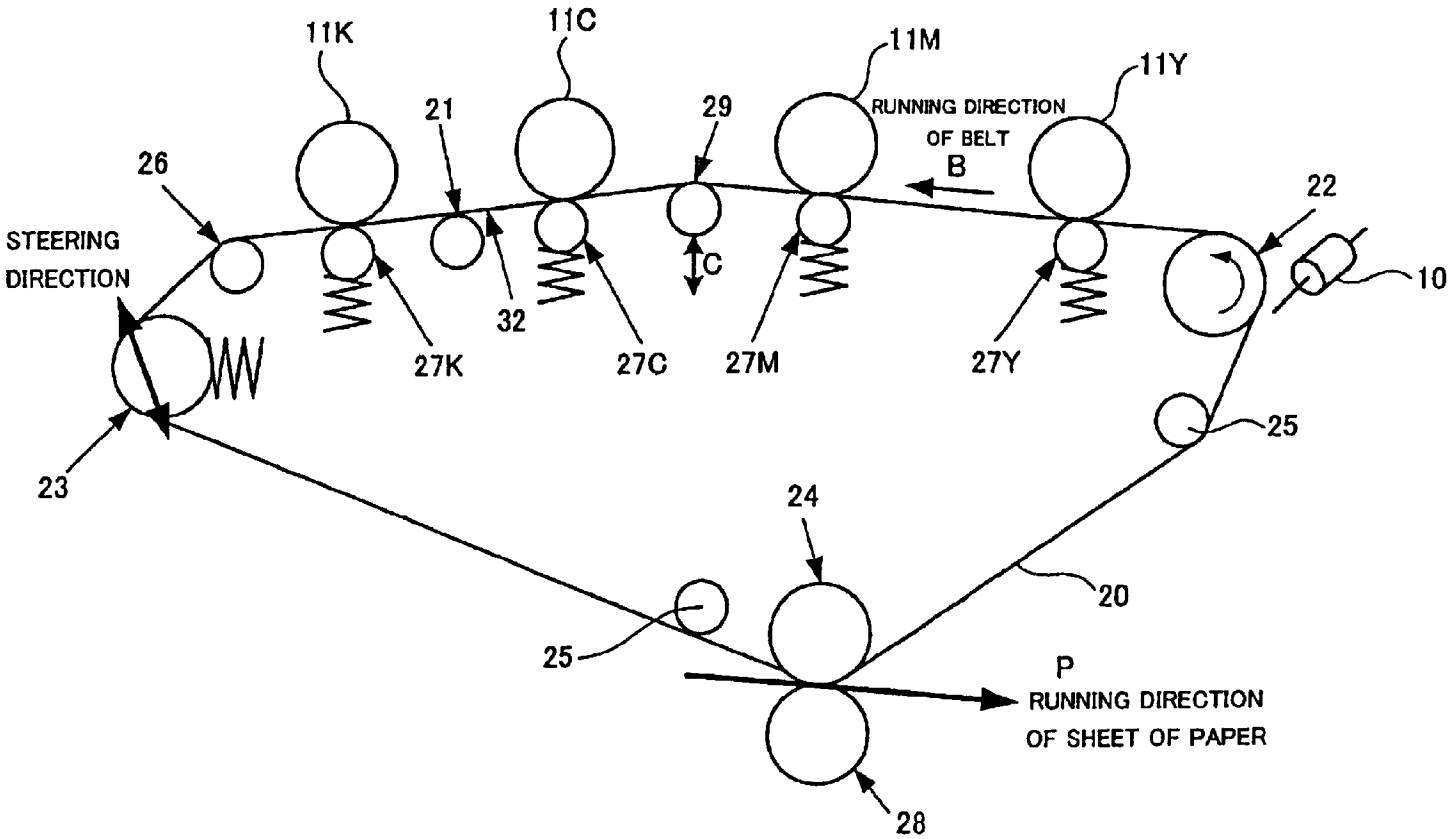
FIG. 2 is a schematic cross sectional view of the first embodiment of image forming apparatus according to the invention as applied to a color copying machine, which is held in a state where an image is being formed in the color mode of operation.
Figure 3:
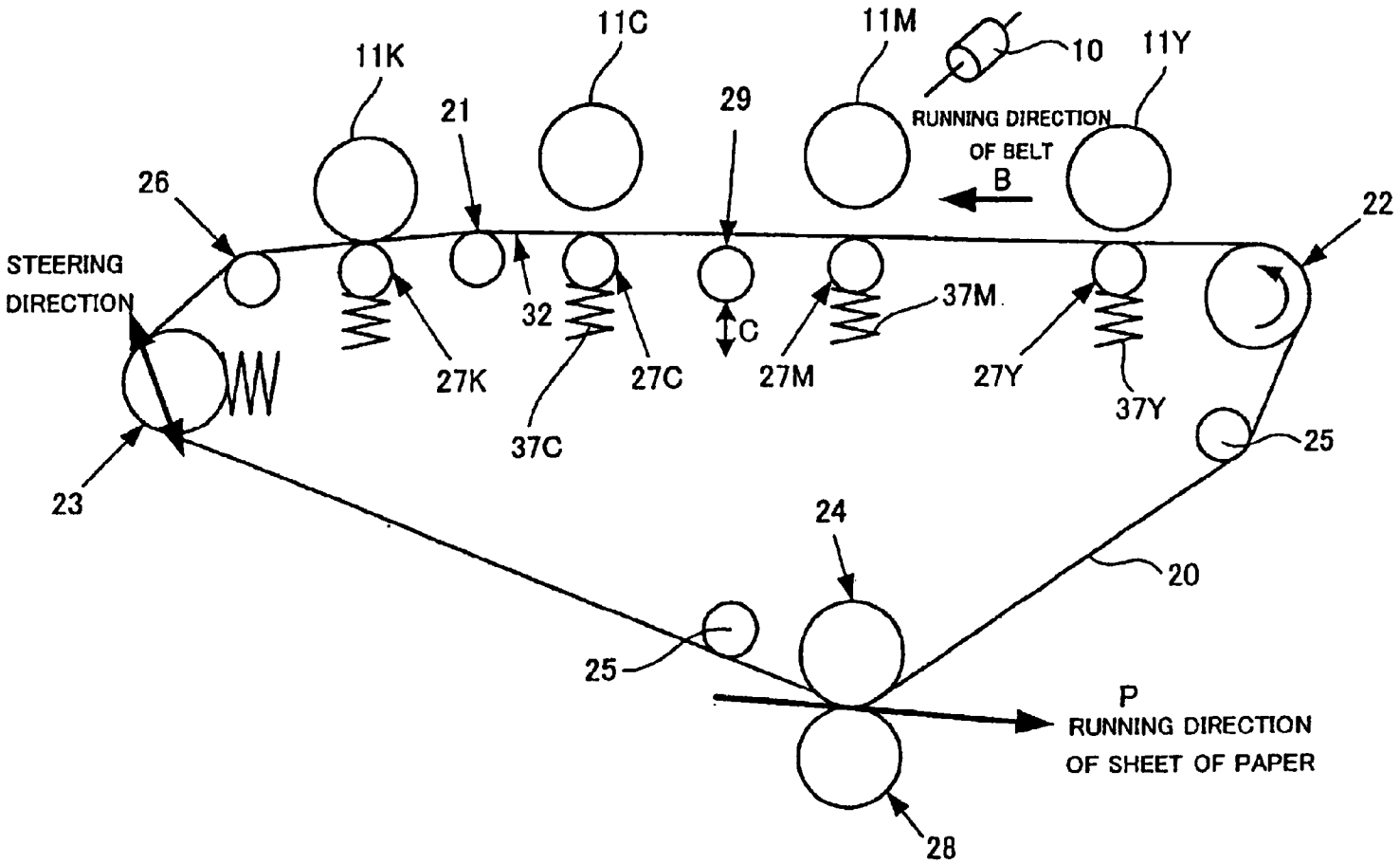
FIG. 3 is a schematic cross sectional view of the first embodiment of image forming apparatus according to the invention as applied to a color copying machine held in a state where an image is being formed in the black and white mode of operation.

FIGS. 2 and 3 are schematic cross sectional views of the first embodiment of image forming apparatus according to the invention as applied to a color copying machine. FIG. 2 illustrates a state where an image is being formed in the color mode of operation, whereas FIG. 3 illustrates a state where an image is being formed in the black and white mode of operation.

Referring to FIGS. 2 and 3, a photosensitized drum 11K adapted to carry a K-color (black) toner image formed thereon and three photosensitized drums 11Y, 11M and 11C adapted to respectively carry toner images of Y-color (yellow), M-color (magenta) and C-color (cyan) formed thereon are arranged horizontally and sequentially. The three photosensitized drums 11Y, 11M and 11C for color images are arranged higher than the level of the photosensitized drum 11K for a black image. An endless intermediate transferring belt 20 is arranged so as to move round on a predetermined course, sequentially passing by or coming into contact with the black image photosensitized drum 11K and the three color image photosensitized drums 11Y, 11M and 11C, in the sense of arrow B as it is driven by a motor 10. Also, the intermediate transferring belt 20 is held by a drive roll 22 for driving the intermediate transferring belt 20, a tension/steering roll 23 for correcting the meandering movement, if any, of the intermediate transferring belt 20, a backup roll 24, a follower roll 26, a tension roll 25, an idle roll 21 and a retractable roll 29 for changing the course of movement of the intermediate transferring belt 20. The retractable roll 29 is adapted to shift from a position for holding itself in contact with the intermediate transferring belt 20 to a position for separating itself from the intermediate transferring belt 20 and vice versa to change the course of round movement of the intermediate transferring belt 20. Further, primary transferring rolls 27Y, 27M, 27C and 27K are arranged at respective positions opposite to the corresponding Further, photosensitized drums 11Y, 11M, 11C and 11K with the intermediate transferring belt 20 nipped between them in order to transfer the respective toner images onto the intermediate transferring belt 20. A secondary transferring roll 28 is arranged at a position opposite to the backup roll 24 with the intermediate transferring belt 20 nipped between them in order to transfer toner images on the intermediate transferring belt 20 onto a sheet of paper.

The distances separating the adjacent ones of the photosensitized drums 11Y, 11M, 11C and 11K are equal to each other on the course of movement of the intermediate transferring belt 20 when it comes into contact with the photosensitized drums. In other words, the intermediate transferring belt 20 travels by the same distance from the photosensitized drums 11Y, 11M and 11C to the respective immediately downstream photosensitized drums 11M, 11C and 11K.

With this arrangement, the timings of operation of forming a color image can be controlled without difficulty.

The rotary shaft of each of the primary transferring rolls 27Y, 27M, 27C and 27K is urged as tension of a predetermined level is applied to it by means of an elastic member and adapted to shift from a position for holding itself in contact with the intermediate transferring belt 20 to a position for separating itself from the belt 20 and vice versa depending on the course of round movement of the belt 20. When it is in the position for holding itself in contact with the intermediate transferring belt 20, a transferring bias voltage is applied thereto to produce a transferring electric field on the intermediate transferring belt 20.

While the primary transferring rolls 27Y, 27M, 27C and 27K are adapted to shift depending on the course of round movement of the intermediate transferring belt 20, it may alternatively be adapted to come into contact with or separated from the intermediate transferring belt 20 in synchronism with the positional shift of the retractable roll 29.

The secondary transferring roll 28 applies pressure to the backup roll 24 with the intermediate transferring belt 20 nipped between them to produce a transferring nip section there. It transfers a toner image on the intermediate transferring belt 20 onto a sheet of paper P each time the sheet of paper P that is laid on the toner image on the intermediate transferring belt 20 passes through the transferring nip section.

The idle roll 21 is secured to a position located substantially at the middle of the stretch between the black image photosensitized drum 11K and the C-color toner image photosensitized drum 11C, while the follower roll 26 is secured to a position between the black image photosensitized drum 11K and the tension/steering roll 23. Thus, the intermediate transferring belt 20 is constantly held in contact with the black image photosensitized drum 11K by the idle roll 21 and the follower roll 26 that are secured to the respective positions.

The retractable roll 29 is arranged between the photosensitized drum 11C for forming a C-color toner image and the photosensitized drum 11M for forming an M-color toner image and adapted to shift from a position where it is held in contact with the intermediate transferring belt 20 to a position where it is separated from the belt 20 in order to cause the belt 20 to be separated from the three photosensitized drums 11Y, 11M and 11C for color images and vice versa in order to cause the belt 20 to come into contact with the three photosensitized drums.

The drive roll 22 is arranged at a position close to and upstream relative to the Y-color toner image photosensitized drum 11Y. The drive roll 22 is adapted to apply tension to the intermediate transferring belt 20 on its course of movement and drive the intermediate transferring belt 20.

The dimensions of the image forming apparatus can be reduced and its component can be laid out easily due to the above described arrangement that the retractable roll 29 is disposed between the color photosensitized drums 11M and 11C and the drive roll 22 and the tension/steering roll 23 are disposed at the opposite sides of the four photosensitized drums 11Y, 11M, 11C and 11K that are arranged in series, more particularly at positions adjacent respectively to the Y-color toner image photosensitized drum 11Y and the black image photosensitized drum 11K, namely, at the opposite ends of the course of round movement of the belt to apply tension to the intermediate transferring belt 20.

Additionally, an edge sensor 32 for detecting the edges of the intermediate transferring belt 20 is arranged near the idle roll 21 that is secured to a predetermined position.

The above expression "near the idle roll 21" refers to a position between the idle roll 21 and the adjacently located photosensitized drum 11C for the C-color or a position between the idle roll 21 and the adjacently located black image photosensitized drum 11K and closer to the idle roll 21 than to the photosensitized drum 11C or 11K, whichever appropriate (within a distance not greater than ½ of the distance between the idle roll 21 and the corresponding photosensitized drum) (the expression "near" will be used in the same sense hereinafter).

The edge sensor 32 can accurately detect the edges of the intermediate transferring belt 20 that can significantly influence the image formation because it is arranged near the idle roll 21 that is secured to a position substantially at the middle of the stretch between the black image photosensitized drum 11K and the photosensitized drum 11C for the C-color.

When the color mode of operation is selected as shown in FIG. 2, the retractable roll 29 is moved upward in the figure to expand the course of the intermediate transferring belt 20 and the three color photosensitized drums 11Y, 11M and 11C are held in contact with the intermediate transferring belt 20.

In this condition, light is irradiated onto the black photosensitized drum 11K and the three color photosensitized drums 11Y, 11M and 11C for exposure to form electrostatic latent images according to the image data for the chromatically separated images of the respective colors, which electrostatic latent images are then developed by toners of the respective colors of Y, M, C and K to produce toner images of the respective colors. The toner images of the colors of Y, M, C and K are sequentially transferred onto the intermediate transferring belt 20 for primary transfer by the primary transferring rolls 27Y, 27M, 27C and 27K at the respective timings when the three color photosensitized drums 11Y, 11M and 11C and the black photosensitized drum 11K come into contact with the intermediate transferring belt 20. Thus, toner images of the different colors are produced on the intermediate transferring belt 20. Subsequently, a sheet of paper P is conveyed to the secondary transferring position where the backup roll 24 and the secondary transferring roll 28 are disposed vis-à-vis with the intermediate transferring belt 20 nipped between them. Then, the toner images of the different colors are sequentially transferred onto the sheet of paper P one upon another for secondary transfer as the sheet is laid on each of the toner images of the different colors on the intermediate transferring belt 20 and nipped. Thereafter, the toner images of the different colors transferred onto the sheet of paper P for secondary transfer are heated under pressure to produce a fixed toner image on the sheet of paper P, which is a color image.

When, on the other hand, the black and white mode of operation is selected as shown in FIG. 3, the retractable roll 29 is moved downward in the figure to produce a straight span on the course of movement between the idle roll 21 and the drive roll 22 for the intermediate transferring belt 20. Thus, the intermediate transferring belt 20 is separated from the three color photosensitized drums 11Y, 11M and 11C that are located at respective positions higher than the black photosensitized drum 11K. In other words, the intermediate transferring belt 20 is now held in contact only with the black photosensitized drum 11K. As the primary transferring rolls 27Y, 27M and 27C are pushed down by the intermediate transferring belt 20, the elastic members 37Y, 37M and 37C may exert urging force upward in the opposite direction. However, the urging force of the intermediate transferring belts 20 is so regulated as to overcome the urging forces of the elastic members 37Y, 37M and 37C.

Resilient members such as springs may typically be used for the elastic members.

In this condition, light is irradiated onto the black photosensitized drum 11K for exposure to form an electrostatic latent image according to the image data for the K-color image, which electrostatic latent image is then developed by toner of the K-color to produce a K-color toner image. The toner image of the K-color is transferred onto the intermediate transferring belt 20 by the primary transferring roll 27K at the timing when the black photosensitized drum 11K comes into contact with the intermediate transferring belt 20. Thus, a K-color toner image is formed on the intermediate transferring belt 20. Subsequently, a sheet of paper P is conveyed to the secondary transferring position where the backup roll 24 and the secondary transferring roll 28 are disposed vis-à-vis with the intermediate transferring belt 20 nipped between them. Then, the K-color toner image is transferred onto the sheet of paper P for secondary transfer as the sheet is laid on the K-color toner image on the intermediate transferring belt 20 and nipped. Thereafter, the K-color toner image transferred onto the sheet of paper P for secondary transfer is heated under pressure to produce a fixed toner image, which is a black and white image.

If an image is formed in the black and white mode of operation from the beginning, the three color photosensitized drums 11Y, 11M and 11C are separated from the intermediate transferring belt 20 and the motor 10 for driving them to rotate is held at rest. However, if operations for forming images in the color mode and those for forming images in the black and white mode are intermingled, the motor 10 is driven to rotate at a reduced rate and held in a standby state for receiving a command for the next printing operation. In this state, the developing agent and drum conditions of the photosensitized drums are kept not too different from those of the black photosensitized drum.

While the motor 10 for driving the three color photosensitized drums of this embodiment is driven to rotate at reduced rate in the black and white mode of operation, the rate may alternatively be reduced to nil.

In this way, while the black photosensitized drum 11K is driven to rotate and rubbed by the intermediate transferring belt 20 in the black and white mode of operation, the three color photosensitized drums 11Y, 11M and 11C are separated from the intermediate transferring belt 20 and the motor 10 is stopped or driven to rotate at a low rate. At the same time, the charger for the three color photosensitized drums 11Y, 11M and 11C and other components relating to image forming operations such as cleaning devices are also stopped or driven to operate less frequently. Thus, they are prevented from unnecessarily being worn and hence can enjoy a long service life.

Figure 4:
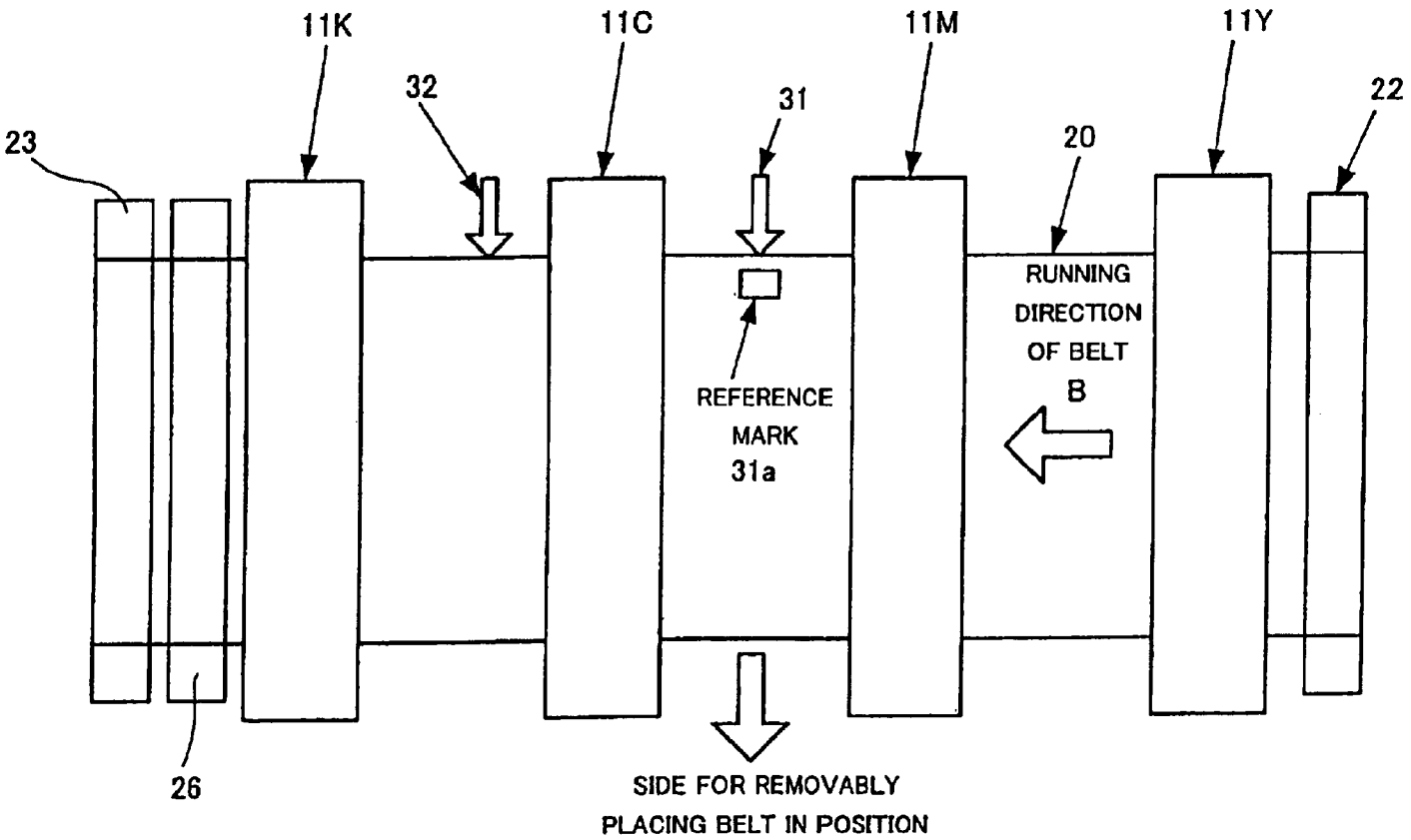
FIG. 4 is a schematic view of the embodiment of image forming apparatus according to the invention as viewed from the side of the photosensitized drums.

FIG. 4 is a schematic view of the present embodiment of image forming apparatus of FIGS. 2 and 3 as viewed from the side of the photosensitized drums.

Referring to FIG. 4, the black photosensitized drum 11K and the three color photosensitized drums 11Y, 11M and 11C, on which toner images of C, M and Y colors are respectively formed, are arranged in a row. The intermediate transferring belt 20 is arranged behind the photosensitized drums in FIG. 4 and held by the drive roll 22, the tension/steering roll 23 and the follower roll 26. It can be removed by moving it leftward as viewed in the moving direction B of the belt 20 (downward in FIG. 4). A reference mark 31*a* to be used for detecting that the intermediate transferring belt has made a full turn is bonded to the surface of the belt 20 opposite to the surface to be used for transferring toner images at the right edge as viewed in the moving direction B of the belt 20, while a reference mark sensor 31 is arranged at a position separated from the belt 20 to detect the passing reference mark 31*a*. The edge sensor 32 for detecting the edges of the intermediate transferring belt 20 is arranged near the idle roll disposed substantially at the middle of the stretch between the black photosensitized drum 11K and the C-color photosensitized drum 11C.

Since the edge sensor 32 is arranged near the idle roll secured to its position, it can reliably detect the edges of the intermediate transferring belt 20 even if the retractable roll is moved to shift the course of the intermediate transferring belt 20. Any meandering movement of the intermediate transferring belt 20 can be prevented from taking place to avoid misregistration of the toner images of different colors transferred onto the intermediate transferring belt 20 by shifting one of the opposite ends of the rotary shaft of the tension/steering roll 23, which is movable, in a direction intersecting the moving direction B of the intermediate transferring belt 20 (or the direction coming upward or downward from the figure) on the basis of the positions of the edges of the intermediate transferring belt 20 as detected by the edge sensor 32.

Thus, since the reference mark sensor 31 and the edge sensor 32 are disposed at the side opposite to the side to be used for removing the intermediate transferring belt 20, the belt 20 will not be damaged when it is placed in position or moved out from the right position.

While the edge sensor 32 is located near the idle roll in this embodiment as pointed out above, it does not necessarily have to be placed near the idle roll. Alternatively, it may be placed at a position that does not alter the course of movement of the intermediate transferring belt 20 or near any of the rolls that are secured in position, although it is preferably placed somewhere around any of the photosensitized drums that significantly influence the formation.

Now, the second embodiment of the invention will be described below.

The second embodiment of image forming apparatus according to the invention differs from the first embodiment in that it has four color photosensitized drums and two retractable rolls. Otherwise, the second embodiment is identical with the first embodiment and hence it will be described only in terms of the differences.

Figure 5:
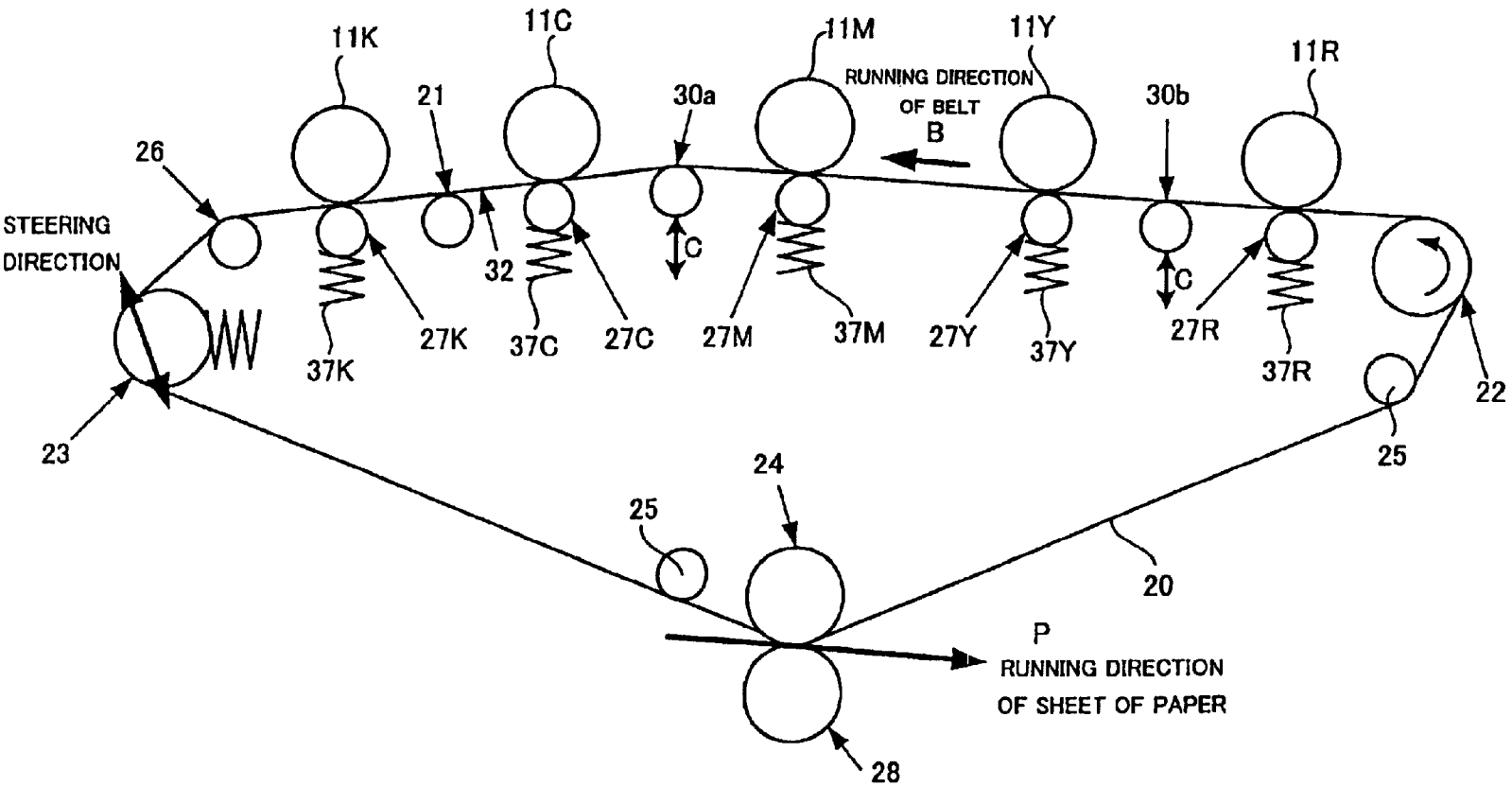
FIG. 5 is a schematic cross sectional view of the second embodiment of image forming apparatus according to the invention, which is held in a state where an image is being formed in the color mode of operation.
Figure 6:
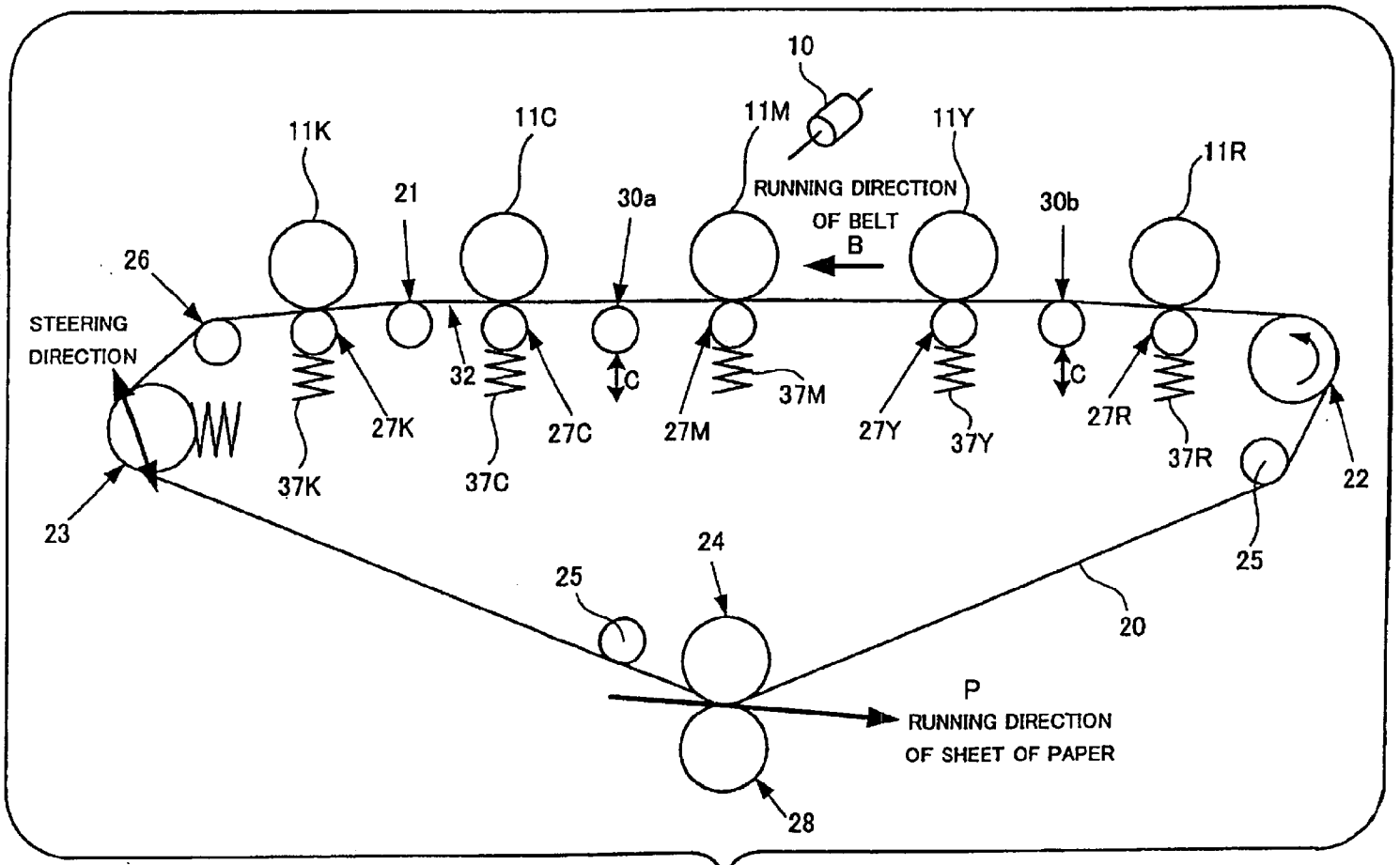
FIG. 6 is a schematic cross sectional view of the second embodiment of image forming apparatus according to the invention held in a state where an image is being formed in the black and white mode plus special color mode of operation.
Figure 7:
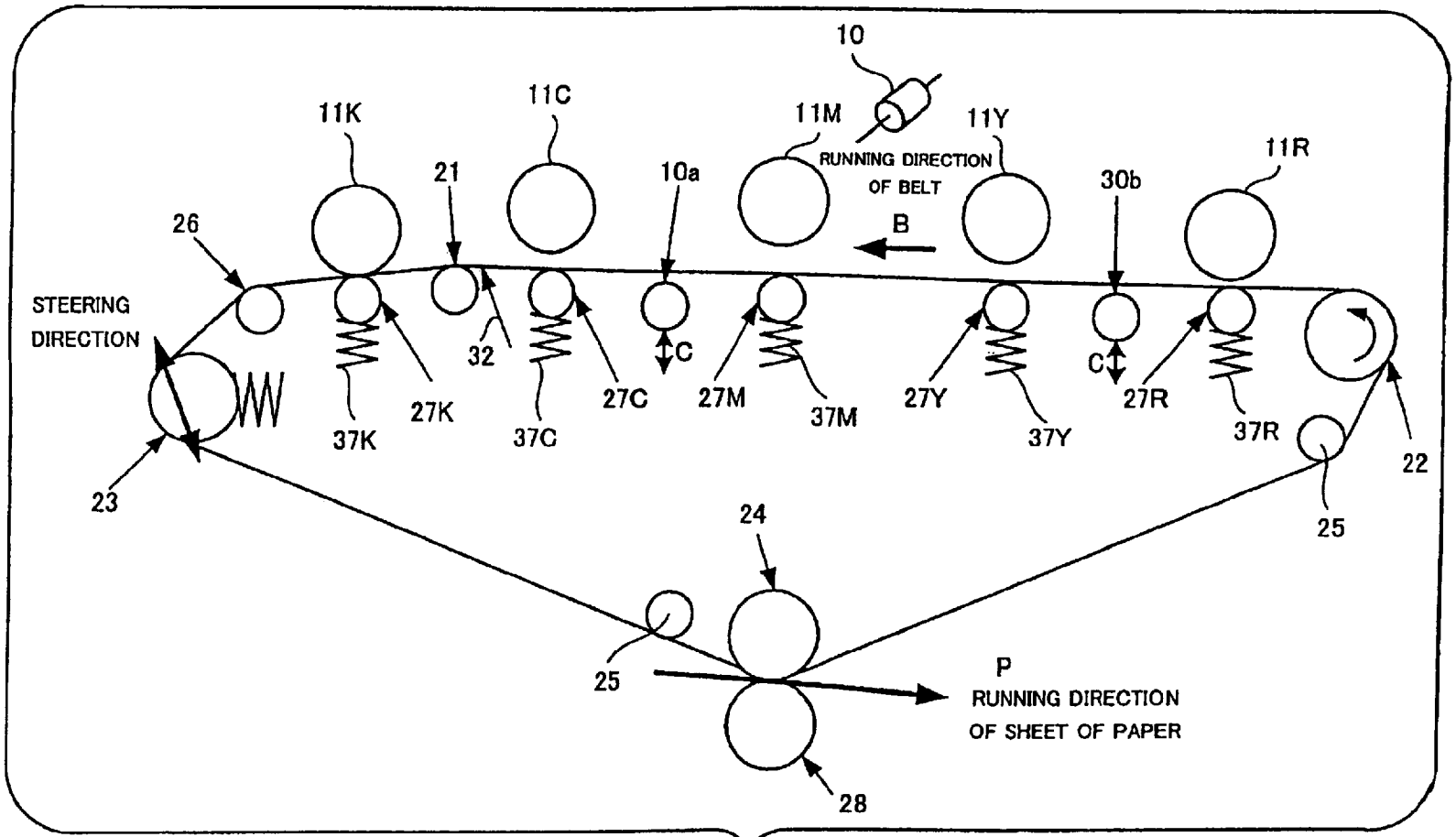
FIG. 7 is a schematic cross sectional view of the second embodiment of image forming apparatus according to the invention held in a state where an image is being formed in the black and white mode of operation.

FIGS. 5, 6 and 7 schematically illustrate the second embodiment of image forming apparatus. FIG. 5 illustrates the embodiment held in a state where an image is being formed in the color mode of operation, whereas FIG. 6 illustrates the embodiment held in a state where an image is being formed in the black and while plus special color mode of operation, and FIG. 7 illustrates the embodiment held in a state where an image is being formed in the black and white mode of operation.

Referring to FIGS. 5, 6 and 7, a photosensitized drum 11K adapted to carry a K-color (black) toner image formed thereon and four photosensitized drums 11Y, 11M, 11C and 11R adapted to respectively carry toner images of Y-color (yellow), M-color (magenta), C-color (cyan) and R-color (special color) formed thereon are arranged horizontally and sequentially. The four photosensitized drums 11Y, 11M, 11C and 11R for color images are arranged higher than the level of the photosensitized drum 11K for a black image. Furthermore, the three photosensitized drums 11Y, 11M and 11C for respectively carrying toner images of Y-color (yellow), M-color (magenta) and C-color (cyan) are arranged higher than the level of the photosensitized drum 11R for carrying a toner image of R-color (special color). An endless intermediate transferring belt 20 is arranged so as to move round on a predetermined course, sequentially passing by or coming into contact with the black image photosensitized drum 11K and the four color image photosensitized drums 11Y, 11M, 11C and 11R, in the sense of arrow B. The intermediate transferring belt 20 is held by a drive roll 22 for driving the intermediate transferring belt 20, a tension/steering roll 23 for correcting the meandering movement, if any, of the intermediate transferring belt 20, a backup roll 24, a follower roll 26, a tension roll 25, an idle roll 21 and a pair of retractable rolls 30*a* and 30*b* for changing the course of movement of the intermediate transferring belt 20. Primary transferring rolls 27R, 27Y, 27M, 27C and 27K are arranged at respective positions opposite to the corresponding photosensitized drums 11R, 11Y, 11M, 11C and 11K with the intermediate transferring belt 20 nipped between them in order to transfer the respective toner images onto the intermediate transferring belt 20. A secondary transferring roll 28 is arranged at the secondary transferring position opposite to the backup roll 24 with the intermediate transferring belt 20 nipped between them in order to transfer toner images on the intermediate transferring belt 20 onto a sheet of paper.

The rotary shafts of the primary transferring rolls 27R, 27Y, 27M, 27C and 27K are urged as tension of a predetermined level is applied to them by means of respective elastic member 37R, 37Y, 37M, 37C and 37K so as to come into contact with the intermediate transferring belt 20 and a transferring bias voltage (not shown) is applied thereto in order to transfer the respective toner images.

The secondary transferring roll 28 applies pressure to the backup roll 24 with the intermediate transferring belt 20 nipped between them to produce a transferring nip section there. It transfers a toner image on the intermediate transferring belt 20 each time the sheet of paper P that is laid on the toner image on the intermediate transferring belt 20 passes through the transferring nip section.

The idle roll 21 is secured to a position located substantially at the middle of the stretch between the black image photosensitized drum 11K and the C-color toner image photosensitized drum 11C, while the follower roll 26 is secured to a position between the black image photosensitized drum 11K and the tension/steering roll 23. Thus, the intermediate transferring belt 20 is constantly held in contact with the black image photosensitized drum 11K by the idle roll 21 and the follower roll 26 that are secured to the respective positions.

The first retractable roll 30*a* is arranged between the photosensitized drum 11C for forming a C-color toner image and the photosensitized drum 11M for forming an M-color toner image and adapted to shift from a position where it is held in contact with the intermediate transferring belt 20 to a position where it is separated from the intermediate transfer belt 20 in order to cause the intermediate transferring belt 20 to be separated from the three photosensitized drums 11Y, 11M and 11C for color images of Y-, M- and C-colors and vice versa in order to cause the belt to come into contact with the three photosensitized drums. The second retractable roll 30*b* is arranged between the color photosensitized drum 11R for a color image of R-color that is disposed most upstream among the five photosensitized drums in the sense of the arrow B and the color photosensitized drum 11Y for a color image of Y-color that is disposed immediately adjacent to the color photosensitized drum 11R for a color image of R-color and adapted to shift from a position where it is held in contact with the intermediate transferring belt 20 to a position where it is separated from the intermediate transferring belt 20 in order to cause the intermediate transferring belt 20 to be separated from the R-color photosensitized drum 11R and vice versa in order to cause the belt to come into contact with the R-color photosensitized drum 11R.

The drive roll 22 is arranged at a position close to and upstream relative to the R-color toner image photosensitized drum 11R. The drive roll 22 is adapted to apply tension to the intermediate transferring belt 20 on the course of movement of the intermediate transferring belt and drive it.

The dimensions of the image forming apparatus can be reduced and its component can be laid out easily due to the above described arrangement that the retractable rolls 30*a* and 30*b* are disposed respectively between the photosensitized drums 11M and 11C and between the photosensitized drums 11R and 11Y and the drive roll 22 and the sensor roll 26 are disposed at the opposite sides of the five photosensitized drums 11R, 11Y, 11M, 11C and 11K that are arranged in series, more particularly at positions adjacent respectively to the photosensitized drum 11R and 11K, to apply tension to the intermediate transferring belt 20.

Additionally, an edge sensor 32 for detecting the edges of the intermediate transferring belt 20 is arranged near the idle roll 21 that is secured to a predetermined position.

The edge sensor 32 can accurately detect the edges of the intermediate transferring belt 20 that can significantly influence the image formation because it is arranged near the idle roll 21 that is secured to a position substantially at the middle of the stretch between the black photosensitized drum 11K and the C-color toner image photosensitized drum 11C.

When the color mode of operation is selected as shown in FIG. 5, both the first retractable roll 30*a* and the second retractable roll 30*b* are moved upward in the figure to expand the course of the intermediate transferring belt 20 and black photosensitized drum 11K and the four color photosensitized drums 11Y, 11M, 11C and 11R are held in contact with the intermediate transferring belt 20.

In this condition, the black photosensitized drum 11K and the four color photosensitized drums 11Y, 11M, 11C and 11R are electrically charged by a charger respectively (not shown) and subsequently light is irradiated onto them for exposure to form electrostatic latent images according to the image data for the chromatically separated images of the respective colors, which electrostatic latent images are then developed by toners of the respective colors of Y, M, C, K and R to produce toner images of the respective colors. The toner images of the colors of Y, M, C, K and R are thereafter sequentially transferred onto the intermediate transferring belt 20 for primary transfer by the primary transferring rolls 27R, 27Y, 27M, 27C and 27K at the respective timings when the four color photosensitized drums 11Y, 11M, 11C and 11R and the black photosensitized drum 11K come into contact with the intermediate transferring belt 20. Thus, toner images of the different colors are produced on the intermediate transferring belt 20. Subsequently, a sheet of paper P is conveyed to the secondary transferring position where the backup roll 24 and the secondary transferring roll 28 are disposed vis-à-vis with the intermediate transferring belt 20 nipped between them. Then, the toner images of the different colors are sequentially transferred onto the sheet of paper P one upon another for secondary transfer as the sheet is laid on each of the toner images of the different colors on the intermediate transferring belt 20 and nipped. Thereafter, the toner images of the different colors transferred onto the sheet of paper P for secondary transfer are heated under pressure to produce a fixed toner image, which is a color image. After the completion of the image forming process, the motor 10 is either stopped to stop the movement of the intermediate transferring belt 20 or decelerated to a low speed to also reduce the moving speed of the intermediate transferring belt 20.

While this embodiment has four color photosensitized drums 11Y, 11M, 11C and 11R, which are adapted to come into contact with the intermediate transferring belt 20, it is not necessary to form a toner image on each and every color photosensitized drum.

When, on the other hand, the black and white plus special color mode of operation is selected, the first retractable roll 30*a* is shifted downward but the second retractable roll 30*b* is held to the high position in FIG. 6. Thus, the intermediate transferring belt 20 follows a straight course of movement between the idle roll 21 and the second retractable roll 30*b*. Therefore, the intermediate transferring belt 20 is separated from the three color photosensitized drums 11Y, 11M, 11C that are located at the respective high positions and comes into contact with only the black photosensitized drum 11K and the special color (R) photosensitized drum 11R.

In this condition, light is irradiated onto the black photosensitized drum 11K and the R-color photosensitized drum 11R for exposure to form respective electrostatic latent images according to the image data for the chromatically separated images of the K and R colors, which electrostatic latent images are then developed by toners of the colors of K and R to produce toner images of the respective colors. The toner images of the colors of K and R are sequentially transferred onto the intermediate transferring belt 20 for primary transfer by the primary transferring rolls 27R and 27K at the respective timings when the R-color photosensitized drum 11R and the black photosensitized drum 11K come into contact with the intermediate transferring belt 20. Thus, toner images of the R- and K-colors are produced on the intermediate transferring belt 20. Subsequently, a sheet of paper P is conveyed to the secondary transferring position where the backup roll 24 and the secondary transferring roll 28 are disposed vis-à-vis with the intermediate transferring belt 20 nipped between them. Then, the toner images of the different colors are sequentially transferred onto the sheet of paper P one upon another for secondary transfer as the sheet is laid on each of the toner images of the different colors on the intermediate transferring belt 20 and nipped. Thereafter, the toner images of the different colors transferred onto the sheet of paper P for secondary transfer are heated under pressure to produce a fixed toner image.

When an image is formed in the black and white plus special color mode of operation from the beginning, the other three color photosensitized drums 11Y, 11M and 11C are separated from the intermediate transferring belt 20 and the motor 10 for driving them to rotate is held at rest. However, if operations for forming images in the color mode and those for forming images in the black and white plus special color mode are intermingled and conducted continuously, the motor 10 is driven to rotate at a reduced rate and held in a standby state for receiving a command for the next printing operation. In this state, and the conditions of the developing agents the photosensitized drums are kept not too different from those of the black photosensitized drum 11K.

While the motor for driving the three color photosensitized drums of this embodiment is driven to rotate at reduced rate when operations for forming images in the color mode and those for forming images in the black and white plus special color mode are intermingled, the rate may alternatively be reduced to nil.

In this way, while the black photosensitized drum 11K and the special color photosensitized drum 11R are driven to rotate and rubbed by the intermediate transferring belt 20, the other three color photosensitized drums 11Y, 11M and 11C are separated from the intermediate transferring belt 20 and the motor 10 is stopped or driven to rotate at a low rate. At the same time, the charger for the three color photosensitized drums 11Y, 11M and 11C and other components relating to image forming operations such as cleaning devices are also stopped or driven to operate less frequently. Thus, they are prevented from unnecessarily being worn and hence can enjoy a long service life.

When the black and white mode of operation is selected as shown in FIG. 7, both the first retractable roll 30*a* and the second retractable roll 30*b* are moved downward in the figure to produce a straight span on the course of movement between the idle roll 21 and the drive roll 22 for the intermediate transferring belt 20. Thus, the intermediate transferring belt 20 is separated from the four color photosensitized drums 11Y, 11M, 11C and 11R. In other words, the intermediate transferring belt 20 is now held in contact only with the black photosensitized drum 11K.

In this state, the toner image of the color K is transferred onto the intermediate transferring belt 20 for primary transfer by the primary transferring roll 27K at the timing when the black photosensitized drum 11K comes into contact with the intermediate transferring belt 20. Thus, a K color toner image is produced on the intermediate transferring belt 20. Subsequently, a sheet of paper P is conveyed to the secondary transferring position where the backup roll 24 and the secondary transferring roll 28 are disposed vis-à-vis with the intermediate transferring belt 20 nipped between them. Then, the K color toner image is transferred onto the sheet of paper P for secondary transfer as the sheet is laid on the K color toner image on the intermediate transferring belt 20 and nipped.

If an image is formed in the black and white mode of operation from the beginning, the four color photosensitized drums 11Y, 11M, 11C and 11R are separated from the intermediate transferring belt 20 and the motor 10 for driving them to rotate is held at rest. However, if operations for forming images in the color mode and those for forming images in the black and white mode are intermingled and conducted continuously, the motor 10 is driven to rotate at a reduced rate and held in a standby state for receiving a command for the next printing operation. In this state, the developing agent and photosensitized drum conditions are kept not too different from those of the black photosensitized drum.

When operations for forming images in the black and white mode and those for forming images in the color mode are intermingled, the motor 10 of this embodiment is driven to rotate at reduced rate, however, the rate may alternatively be reduced to nil to stop the rotary motion.

In this way, while the black photosensitized drum 11K is driven to rotate and rubbed by the intermediate transferring belt 20, the four color photosensitized drums 11Y, 11M, 11C and 11R are separated from the intermediate transferring belt 20 and the motor 10 is stopped or driven to rotate at a low rate. At the same time, the charger for the four color photosensitized drums 11Y, 11M, 11C and 11R and other components relating to image forming operations such as cleaning devices are also stopped or driven to operate less frequently. Thus, they are prevented from unnecessarily being worn and hence can enjoy a long service life.

Now, the third embodiment of the invention will be described below.

The third embodiment differs from the first embodiment in that an endless sheet conveyor belt is arranged so as to move round on a predetermined course, sequentially passing by the image forming positions of the image forming apparatus in place of an intermediate transferring belt. Otherwise, the third embodiment is identical with the first embodiment and hence it will be described only in terms of the differences.

Figure 8:
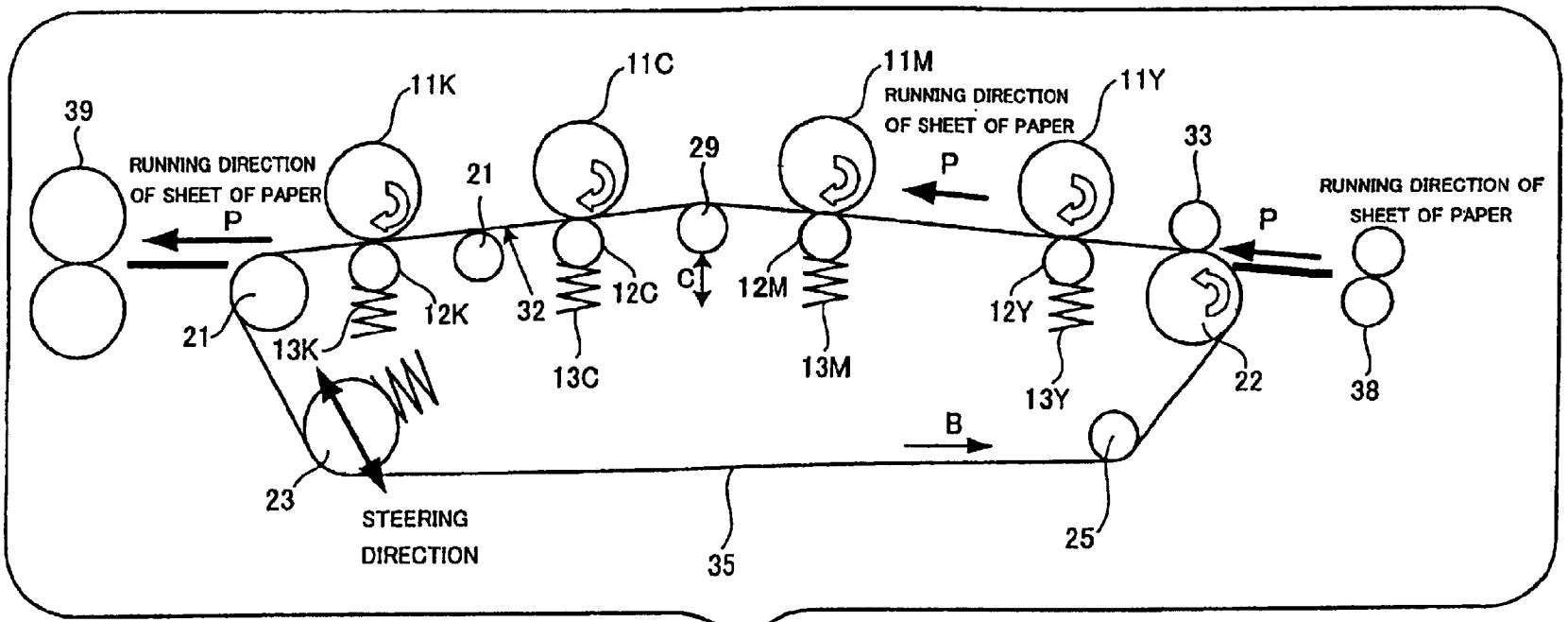
FIG. 8 is a schematic cross sectional view of the third embodiment of image forming apparatus according to the invention as applied to a color copying machine, which is held in a state where an image is being formed in the color mode of operation.
Figure 9:
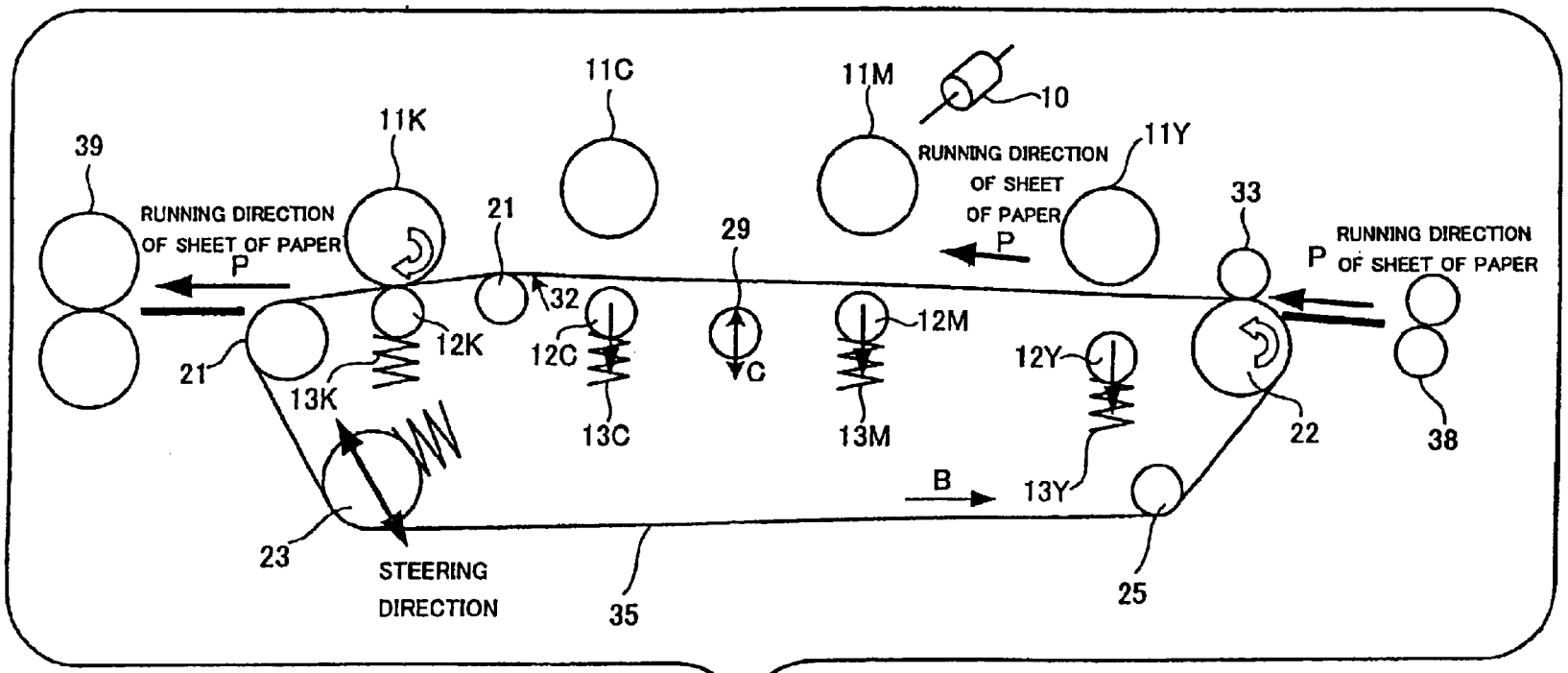
FIG. 9 is a schematic cross sectional view of the third embodiment of image forming apparatus according to the invention as applied to a color copying machine held in a state where an image is being formed in the black and white mode of operation.

FIGS. 8 and 9 schematically illustrate the third embodiment of image forming apparatus according to the invention as applied to a color copying machine. FIG. 8 illustrates the third embodiment held in a state where an image is being formed in the color mode of operation, whereas FIG. 9 illustrates where an image is being formed in the black and white mode of operation.

Referring to FIGS. 8 and 9, a photosensitized drum 11K adapted to carry a K-color (black) toner image formed thereon and three photosensitized drums 11Y, 11M and 11C adapted to respectively carry toner images of Y-color (yellow), M-color (magenta) and C-color (cyan) formed thereon are arranged horizontally and sequentially. The three photosensitized drums 11Y, 11M and 11C for color images are arranged higher than the level of the photosensitized drum 11K for a black image. An endless sheet conveyor belt 35 is arranged so as to move round on a predetermined course, sequentially passing by or coming into contact with the black image photosensitized drum 11K and the three color image photosensitized drums 11Y, 11M and 11C, in the sense of arrow B as it is driven by a motor 10. Also, the sheet conveyor belt 35 is held by a drive roll 22 for driving the sheet conveyor belt 35, a tension/steering roll 23 for correcting the meandering movement, if any, of the sheet conveyor belt 35, idle rolls 21 and a retractable roll 29 for changing the course of movement of the sheet conveyor belt 35. Transferring rolls 12Y, 12M, 12C and 12K are arranged at respective positions opposite to the corresponding photosensitized drums 11Y, 11M, 11C and 11K with the sheet conveyor belt 35 nipped between them in order to transfer the respective toner images onto a sheet of paper P carried on the sheet conveyor belt 35. A registration unit 38 and an adsorption roll 33 are arranged upstream relative to the three color photosensitized drums 11Y, 11M and 11C. The registration unit 38 is adapted to regulate the timing of feeding the sheet of paper P that is conveyed to the image forming positions, whereas the adsorption roll 33 is disposed opposite to the drive roll 22 and adapted to rotate with it, pinching the sheet conveyor belt 35 between itself and the drive roll 22. An electrostatic charge is applied to the sheet of paper P fed from the registration unit 38 by the adsorption roll 33 and then the sheet of paper P is adsorbed by the sheet conveyor belt 35 and moved forward. A fixing device 39 having a pair of rolls is arranged downstream relative to the black photosensitized drum 11K. Thus, as the sheet of paper P, onto which the toner images have been sequentially transferred, is nipped between the pair of rolls and heated under pressure, a fixed complete toner image is produced on the sheet of paper P.

The rotary shaft of each of the transferring rolls 12Y, 12M, 12C and 12K is urged and held in contact with the sheet conveyor belt 35 as tension of a predetermined level is applied to it by means of elastic members 13Y, 13M, 13C and 13K. For each transferring operation, a transferring bias voltage is applied to the related one of the transferring rolls to produce a transferring electric field on the sheet conveyor belt 35.

The idle rolls 21 are secured to respective positions located substantially at the middle of the stretch between the black image photosensitized drum 11K and the C-color toner image photosensitized drum 11C and between the black image photosensitized drum 11K and the tension/steering roll 23. Thus, the sheet conveyor belt 35 is constantly held in contact with the black image photosensitized drum 11K by the two idle rolls 21 that are secured to the respective positions.

The retractable roll 29 is arranged between the photosensitized drum 11C for forming a C-color toner image and the photosensitized drum 11M for forming an M-color toner image and adapted to shift from a position where it is held in contact with the sheet conveyor belt 35 to a position where it is separated from the sheet conveyor belt 35 in order to cause the sheet conveyor belt 35 to be separated from the three photosensitized drums 11Y, 11M and 11C for color images and vice versa in order to cause the belt to come into contact with the three photosensitized drums.

The drive roll 22 is arranged at a position close to and upstream relative to the Y-color toner image photosensitized drum 11Y. The drive roll 22 is adapted to apply tension to the sheet conveyor belt 35 on its course of movement and drive the sheet conveyor belt 35.

The dimensions of the image forming apparatus can be reduced and its component can be laid out easily due to the above described arrangement that the retractable roll 29 is disposed between the color photosensitized drums 11M and 11C and the drive roll 22 and one of the idle rolls 21 are disposed at the opposite sides of the four photosensitized drums 11Y, 11M, 11C and 11K that are arranged in series, to apply tension to the sheet conveyor belt 35.

Additionally, an edge sensor 32 for detecting the edges of the sheet conveyor belt 35 is arranged near the idle roll 21 that is secured to a position between the C-color toner image photosensitized drum 11C and the black toner image photosensitized drum 11K.

The edge sensor 32 can accurately detect the edges of the sheet conveyor belt 35 that can significantly influence the image formation because it is arranged near the idle roll 21 that is secured to a position substantially at the middle of the stretch between the black image photosensitized drum 11K and the C-color toner image photosensitized drum 11C.

When the color mode of operation is selected as shown in FIG. 8, the retractable roll 29 is moved upward in the figure to expand the course of the sheet conveyor belt 35 and the three color photosensitized drums 11Y, 11M and 11C are held in contact with the sheet conveyor belt 35.

In this condition, light is irradiated onto the black photosensitized drum 11K and the three color photosensitized drums 11Y, 11M and 11C for exposure to form electrostatic latent images according to the image data for the chromatically separated images of the respective colors, which electrostatic latent images are then developed by toners of the respective colors of Y, M, C and K to produce toner images of the respective colors. The toner images of the colors of Y, M, C and K are sequentially transferred onto the sheet of paper P one upon another by the transferring roll 12 at the respective timings when the sheet of paper P fed from the registration unit 38 comes into contact with the toner images on the three color photosensitized drums 11Y, 11M and 11C and the black photosensitized drum 11K. Thus, toner images of the different colors are produced on the sheet of paper P.

Thereafter, the toner images of the different colors transferred onto the sheet of paper P are heated under pressure by the fixing device 39 to produce a fixed toner image on the sheet of paper P, which is a color image.

When, on the other hand, the black and white mode of operation is selected as shown in FIG. 9, the retractable roll 29 is moved downward along with the transferring rolls 12Y, 12M and 12C respectively opposing to the three color photosensitized drums 11Y, 11M and 11C in the figure to produce a straight span on the course of movement between the right side idle roll 21 and the drive roll 22 for the sheet conveyor belt 35. Thus, the sheet conveyor belt 35 is separated from the three color photosensitized drums 11Y, 11M and 11C that are located at respective positions higher than the black photosensitized drum 11K. In other words, the sheet conveyor belt 35 is now held in contact only with the black photosensitized drum 11K by the idle rolls 21 disposed at the opposite sides of the black photosensitized drum 11K.

In this condition, a toner image of K-color is formed on the black photosensitized drum 11K and subsequently transferred onto the sheet of paper P at the timing when the sheet of paper P is brought into contact with the black photosensitized drum 11K by the transfer roll 12K. Thereafter, the K-color toner image transferred onto the sheet of paper P is heated under pressure by the fixing device 39 to produce a fixed toner image on the sheet of paper P, which is a black and white image.

If an image is formed in the black and white mode of operation from the beginning, the three color photosensitized drums 11Y, 11M and 11C are separated from the sheet conveyor belt 35 and the motor 10 for driving them to rotate is held at rest. However, if operations for forming images in the color mode and those for forming images in the black and white mode are intermingled and conducted continuously, the motor 10 is driven to rotate at a reduced rate and held in a standby state for receiving a command for the next printing operation. In this state, the developing agent and photosensitized drum conditions are kept not too different from those of the black photosensitized drum.

While the motor for driving the three color photosensitized drums of this embodiment is driven to rotate at reduced rate in the black and white mode of operation, the rate may alternatively be reduced to nil to completely stop the rotary motion of the motor.

In this way, while the black photosensitized drum 11K is driven to rotate and rubbed by the sheet conveyor belt 35, the three color photosensitized drums 11Y, 11M and 11C are separated from the sheet conveyor belt 35 and the motor 10 is stopped or driven to rotate at a low rate. At the same time, the charger for the three color photosensitized drums 11Y, 11M and 11C and other components relating to image forming operations such as cleaning devices are also stopped or driven to operate less frequently. Thus, they are prevented from unnecessarily being worn and hence can enjoy a long service life.

Now, the fourth embodiment of the invention will be described.

The fourth embodiment differs from the second embodiment in that an endless sheet conveyor belt 35 is arranged so as to move round on a predetermined course, sequentially passing by the image forming positions of the image forming apparatus in place of an intermediate transferring belt 20. Otherwise, the fourth embodiment is identical with the second embodiment. The fourth embodiment differs from the third embodiment in that it has a special color photosensitized drum 11R but resembles the third embodiment in terms of the use of a sheet conveyor belt 35. Therefore, it will not be described any further.

What is claimed is:

1. An image forming apparatus that forms an image by forming toner images and fixes the toner images on a recording medium, the apparatus comprising:

a plurality of sensitized bodies arranged in a row and including a black sensitized body adapted to carry a black image formed thereon and a plurality of color sensitized bodies adapted to carry respective images of different colors other than black formed thereon, the black sensitized body being disposed at one of the opposite ends of the row of sensitized bodies;

a belt adapted to move round on a course, sequentially passing by or coming into contact with the plurality of sensitized bodies, the belt directly receiving thereon or receiving on a recording medium carried by the belt the toner images formed on the plurality of sensitized bodies;

a first roll secured in position between the black sensitized body and the immediately adjacent color sensitized body and adapted to cause the belt to come into contact with the black sensitized body; and at least one retractable roll adapted to locate between the two of the color sensitized bodies in one end of the row, wherein one of the two color sensitized bodies is disposed immediately adjacent to the black sensitized body, or one of the two color sensitized bodies is disposed at an opposite end of the row, and adapted to shift from a position for holding itself in contact with the belt to a position for separating itself from the belt and vice versa to change the course of round movement of the belt;

a plurality of transferring members positioned directly opposite to the plurality of sensitized bodies and adapted to nip the belt with at least one of the sensitized bodies; and two second rolls at the opposite ends of the row of sensitized bodies and held at the opposite ends of the course of round movement of the belt, each of the two second rolls having an axis of rotation stationary with respect to the plurality of sensitized bodies, wherein the at least one retractable roll is adapted to actively position each of the plurality of transferring members such that attachment and detachment of the belt is exclusively under control of the at least one retractable roll.

2. The apparatus according to claim 1, further comprising: an edge sensor that detects positions of the edges of the belt.

3. The apparatus according to claim 1, wherein the retractable roll is adapted to cause the belt to come into contact with or become separated from a predetermined one of the plurality of color sensitized bodies by changing the course.

4. The apparatus according to claim 2, further comprising:

a motor that moves the plurality of color sensitized bodies, the motor being adapted to stop or reduce the speed of the movements of the color sensitized bodies separated from the belt as a result of the change of the course of movement of the belt caused by the retractable roll.

5. The apparatus according to claim 1, wherein the plurality of transferring members transfers the toner images formed on the sensitized bodies onto the belt or the recording medium carried by the belt.

6. The apparatus according to claim 1, wherein the plurality of sensitized bodies are arranged so as to make the belt travel by the same distance between any upstream sensitized body and the immediately downstream sensitized body on the course of movement for sequentially coming into contact with the sensitized bodies.

7. The apparatus according to claim 1, wherein the at least one retractable roll includes more than one retractable rolls.

8. The apparatus according to claim 7, wherein at least one of the retractable rolls is arranged between the two color sensitized bodies, wherein one of the two color sensitized bodies is disposed at the opposite end of the row from the black sensitized body.

9. The apparatus according to claim 1, wherein the black sensitized body and the plurality of color sensitized bodies are arranged in a horizontal direction and a level of the black sensitized body is different from those of the plurality of color sensitized bodies.

* * * * *